US012415961B2

(12) United States Patent
Koseoglu et al.

(10) Patent No.: US 12,415,961 B2
(45) **Date of Patent: *Sep. 16, 2025**

(54) REVERSE ISOMERIZATION PROCESS USING FEEDSTOCK CONTAINING DISSOLVED HYDROGEN

(71) Applicant: Saudi Arabian Oil Company, Dhahran (SA)

(72) Inventors: Omer Refa Koseoglu, Dhahran (SA); Vishvedeep Bhat, Dhahran (SA); Vinod Ramaseshan, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

This patent is subject to a terminal disclaimer.

(21) Appl. No.: 18/650,522

(22) Filed: Apr. 30, 2024

(65) Prior Publication Data

US 2024/0287394 A1 Aug. 29, 2024

Related U.S. Application Data

(63) Continuation of application No. 18/055,531, filed on Nov. 15, 2022, now Pat. No. 11,999,912.

(51) Int. Cl.
*C10G 45/58* (2006.01)
*C10G 55/06* (2006.01)

(52) U.S. Cl.
CPC ..... *C10G 45/58* (2013.01); *C10G 55/06* (2013.01); *C10G 2300/1096* (2013.01); *C10G 2400/20* (2013.01)

(58) Field of Classification Search
CPC C10G 45/58; C10G 55/06; C10G 2300/1096; C10G 2400/20
USPC ..... 585/664
See application file for complete search history.

(56) References Cited

U.S. PATENT DOCUMENTS

| | | | | |
|---|---|---|---|---|
| 10,260,011 | B2 | 4/2019 | Ward et al. | |
| 11,155,757 | B2 | 10/2021 | Koseoglu | |
| 2021/0277316 | A1* | 9/2021 | Funk | C10G 61/06 |

* cited by examiner

*Primary Examiner* — Prem C Singh
*Assistant Examiner* — Francis C Campanell
(74) *Attorney, Agent, or Firm* — DINSMORE & SHOHL LLP

(57) ABSTRACT

A process for reverse isomerization of a light naphtha feedstock containing branched $C_5$-$C_7$ paraffins. The process includes feeding a mixed feed stream including the light naphtha feedstock to a separation unit to generate an iso-paraffin stream and one or more normal paraffin streams. The process further includes mixing hydrogen gas and a hydrocarbon feed stream containing the iso-paraffin stream to form a hydrogen-enriched liquid feed stream which is provided to a reverse isomerization reactor. The hydrogen-enriched liquid feed stream is contacted with a solid reverse isomerization catalyst for reverse hydroisomerization in a substantially two-phase liquid-solid reverse isomerization fixed-bed reaction zone convert iso-paraffins to normal paraffins. The isomerization effluent stream is provided to a stabilization column to generate a stabilized isomerate stream which is combined with the light naphtha feedstock to generate the mixed feed stream. An associated system for performing the process is also provided.

17 Claims, 8 Drawing Sheets

REVERSE ISOMERIZATION PROCESS USING FEEDSTOCK CONTAINING DISSOLVED HYDROGEN

CROSS REFERENCE TO RELATED APPLICATION

This application is a continuation application of U.S. patent application Ser. No. 18/055,531, filed Nov. 15, 2022, the entire contents of which are hereby incorporated by reference in the present disclosure.

TECHNICAL FIELD

The present disclosure relates to processes for reverse isomerization of a light naphtha feedstock comprising branched $C_5$-$C_7$ paraffins and more particularly reverse isomerization processes using a hydrogen-enriched liquid feed stream.

BACKGROUND

Ethylene and propylene are important chemicals for use in the production of other useful materials, such as polyethylene and polypropylene. Polyethylene and polypropylene are two of the most common plastics found in use today and have a wide variety of uses. Uses for ethylene and propylene include the production of vinyl chloride, ethylene oxide, ethylbenzene and alcohol.

Typically ethylene utilized for the production of plastics and petrochemicals such as polyethylene is generated by the thermal cracking of low molecular weight hydrocarbons. One such method involves mixing steam with a feed stream to the cracking reactor to reduce the hydrocarbon partial pressure and enhance olefin yield and to reduce the formation and deposition of carbonaceous material in the cracking reactors. The process is therefore often referred to as a steam cracking reaction or pyrolysis.

The composition of the feed to the steam cracking reactor affects the product distribution. As one skilled in the art understands, certain hydrocarbons are easier to cracker into shorter chain molecules for generation of ethylene than other hydrocarbons. Typically normal paraffins are the easiest to crack followed by iso-paraffins, olefins, naphthenes, and aromatics each being sequentially more challenging. As such, increasing the concentration of normal paraffins in a stream can improve the quality of a feedstock to the steam cracking unit.

SUMMARY

Accordingly, an efficient process for increasing the concentration of normal paraffins in the feedstream to a steam cracking reactor would yield a significant increase in the profitability of steam cracking operations by increasing the yield of high value products such as ethylene and propylene.

There is a clear and long-standing need to provide an efficient and economical process for the production of ethylene and propylene, from a feedstock comprising substantial quantities of light naphtha and in particular shifting of the balance of normal paraffins and iso-paraffins to capture increased quantities of normal paraffins.

In accordance with one or more embodiments of the present disclosure, a process for reverse isomerization of a light naphtha feedstock comprising branched $C_5$-$C_7$ paraffins is disclosed. The process includes feeding a mixed feed stream comprising the light naphtha feedstock to a separation unit to generate an iso-paraffin stream and one or more normal paraffin streams; mixing hydrogen gas and a hydrocarbon feed stream comprising the iso-paraffin stream to form a hydrogen-enriched liquid feed stream; providing the hydrogen-enriched liquid feed stream to a reverse isomerization reactor; operating the reverse isomerization reactor by contacting the hydrogen-enriched liquid feed stream with a solid reverse isomerization catalyst for reverse hydroisomerization in a substantially two-phase liquid-solid reverse isomerization fixed-bed reaction zone under conditions that minimize cracking reactions and that are effective to convert iso-paraffins to normal paraffins and recovering an equilibrium composition of normal and iso paraffins in an isomerization effluent stream; providing the isomerization effluent stream to a stabilization column to separate the isomerization effluent stream into a $C_1$-$C_4$ hydrocarbon stream and a stabilized isomerate stream; and combining the stabilized isomerate stream with the light naphtha feedstock to generate the mixed feed stream.

Additional features and advantages of the described embodiments will be set forth in the detailed description that follows. The additional features and advantages of the described embodiments will be, in part, readily apparent to those skilled in the art from that description or recognized by practicing the described embodiments, including the detailed description that follows as well as the drawings and the claims.

BRIEF DESCRIPTION OF THE DRAWINGS

The following detailed description of specific embodiments of the present disclosure can be best understood when read in conjunction with the following drawings in which.

Figure 1:
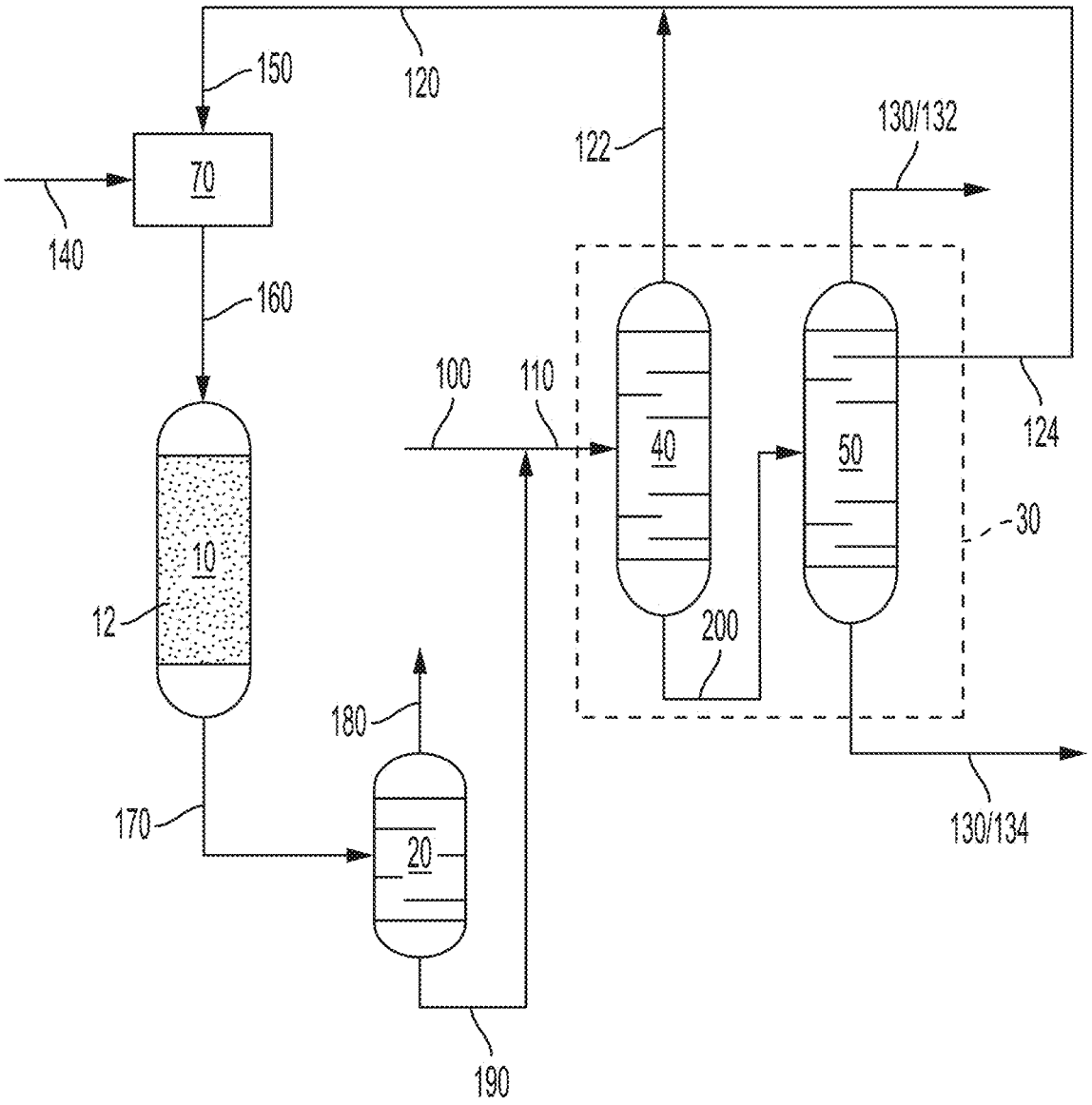
FIG. 1 is a schematic illustration of one or more embodiments of the process for reverse isomerization of a light naphtha feedstock of the present disclosure.

For the purpose of describing the simplified schematic illustrations and descriptions of FIGS. 1 through 8 the numerous valves, temperature sensors, electronic controllers, and the like that may be employed and well known to those of ordinary skill in the art of certain chemical processing operations are not included. Further, accompanying components that are often included in chemical processing operations, such as, for example, air supplies, heat exchangers, surge tanks, catalyst hoppers, or other related systems are not depicted. It would be known that these components are within the spirit and scope of the present embodiments disclosed. However, operational components, such as those described in the present disclosure, may be added to the embodiments described in this disclosure.

It should further be noted that arrows in the drawings refer to process streams. However, the arrows may equivalently refer to transfer lines that may serve to transfer process streams between two or more system components. Additionally, arrows that connect to system components define inlets or outlets in each given system component. The arrow direction corresponds generally with the major direction of movement of the materials of the stream contained within the physical transfer line signified by the arrow. Furthermore, arrows that do not connect two or more system components signify a product stream which exits the depicted system or a system inlet stream which enters the depicted system. Product streams may be further processed in accompanying chemical processing systems or may be commercialized as end products. System inlet streams may be streams transferred from accompanying chemical processing systems or may be non-processed feedstock streams. Some arrows may represent recycle streams, which are effluent streams of system components that are recycled back into the system. However, it should be understood that any represented recycle stream, in some embodiments, may be replaced by a system inlet stream of the same material, and that a portion of a recycle stream may exit the system as a system product.

Additionally, arrows in the drawings may schematically depict process steps of transporting a stream from one system component to another system component. For example, an arrow from one system component pointing to another system component may represent "passing" a system component effluent to another system component, which may include the contents of a process stream "exiting" or being "removed" from one system component and "introducing" the contents of that product stream to another system component.

It should be understood that two or more process streams are "mixed" or "combined" when two or more lines intersect in the schematic flow diagrams. Mixing or combining may also include mixing by directly introducing both streams into a like reactor, separation device, or other system component. For example, it should be understood that when two streams are depicted as being combined directly prior to entering a separation unit or reactor, that in some embodiments the streams could equivalently be introduced into the separation unit or reactor and be mixed in the reactor.

Reference will now be made in greater detail to various embodiments, some embodiments of which are illustrated in the accompanying drawings. Whenever possible, the same reference numerals will be used throughout the drawings to refer to the same or similar parts.

DETAILED DESCRIPTION

Reference will now be made in detail to embodiments of a process for reverse isomerization of a light naphtha feedstock to generate increased normal paraffin production in accordance with the present disclosure. While the associated system for reverse isomerization of a light naphtha feedstock comprising branched $C_5$-$C_7$ paraffins of FIGS. 1 through 8 are provided as exemplary embodiments, it should be understood that the present processes and systems may encompass other configurations.

In one or more embodiments and generally with reference to FIG. 1 through 4, a process for reverse isomerization of a light naphtha feedstock 100 comprising branched $C_5$-$C_7$ paraffins includes feeding a mixed feed stream 110 comprising the light naphtha feedstock 100 to a separation unit 30 to generate an iso-paraffin stream 120 and one or more normal paraffin streams 130. The process further includes mixing hydrogen gas 140 and a hydrocarbon feed stream 150 comprising the iso-paraffin stream 120 to form a hydrogen-enriched liquid feed stream 160. Further, the process includes providing the hydrogen-enriched liquid feed stream 160 to a reverse isomerization reactor 10 and operating the reverse isomerization reactor 10 by contacting the hydrogen-enriched liquid feed stream 160 with a solid reverse isomerization catalyst 12 for reverse hydroisomerization in a substantially two-phase liquid-solid reverse isomerization fixed-bed reaction zone under conditions that minimize cracking reactions and that are effective to convert iso-paraffins to normal paraffins. An equilibrium composition of normal and iso paraffins is recovered in an isomerization effluent stream 170. The isomerization effluent stream 170 is provided to a stabilization column 20 to separate the isomerization effluent stream 170 into a $C_1$-$C_4$ hydrocarbon stream 180 and a stabilized isomerate stream 190. The stabilized isomerate stream 190 is then combined with the light naphtha feedstock 100 to generate the mixed feed stream 110 to generate a circular process.

Figure 2:
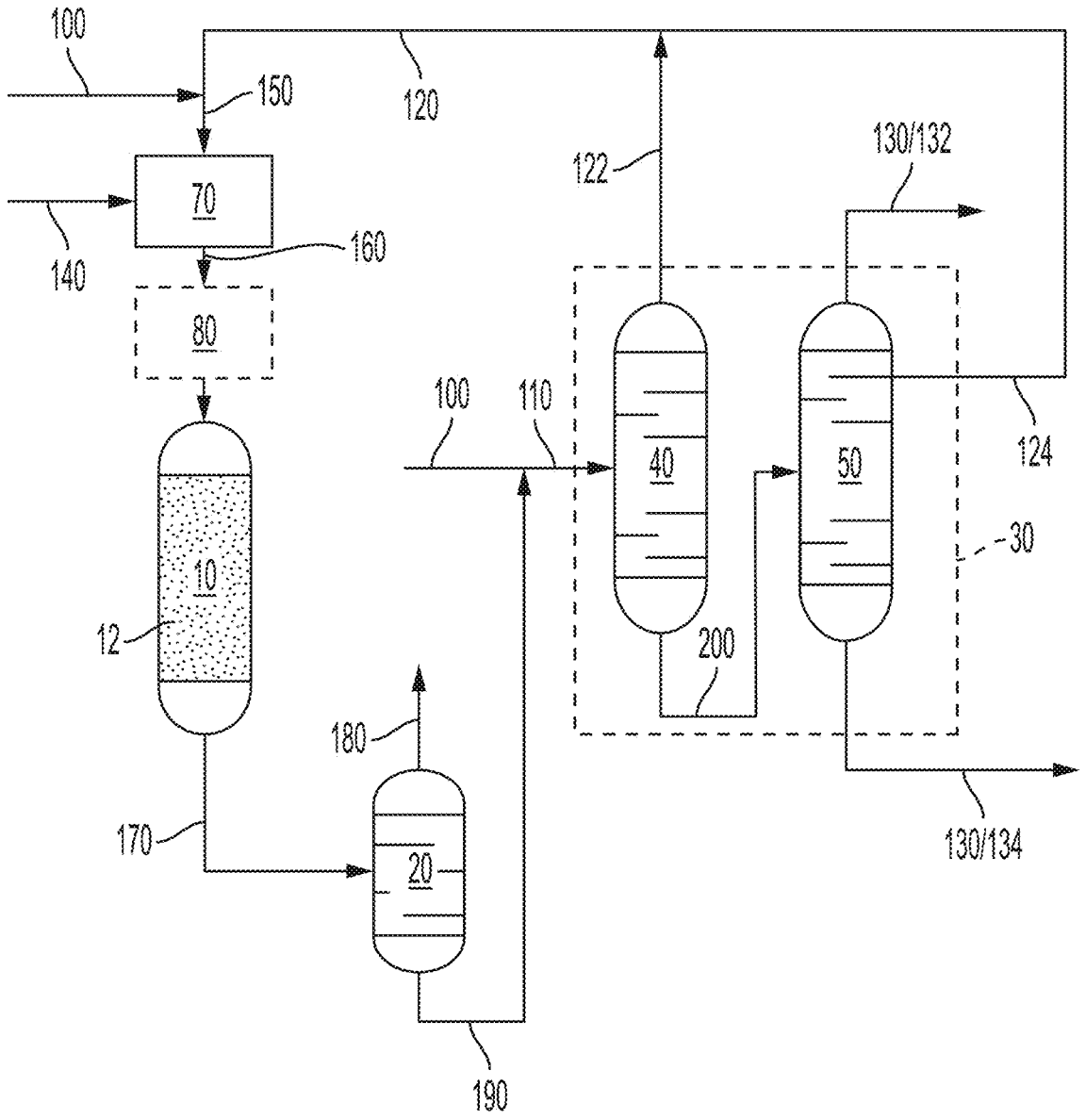
FIG. 2 is a schematic illustration of one or more embodiments of the process for reverse isomerization of a light naphtha feedstock of the present disclosure as illustrated in FIG. 1 including a second light naphtha feed.

In one or more further embodiments and generally with reference to FIGS. 1 and 2, the separation unit 30 includes a deisopentanizer column 40 and a fractionator 50. In accordance with such embodiments, the mixed feed stream 110 is provided to the deisopentanizer column 40 to separate iso-pentane as an iso-pentane stream 122 from the mixed feed stream 110 to generate a deisopentanizer effluent 200 comprising normal pentane and hexanes. The deisopentanizer effluent 200 is provided to the fractionator 50 to generate an iso-hexanes stream 124, a normal pentane stream 132, and a normal hexane stream 134. The iso-pentane stream 122 and the iso-hexanes stream 124 are then combined to generate the iso-paraffin stream 120.

Figure 3:
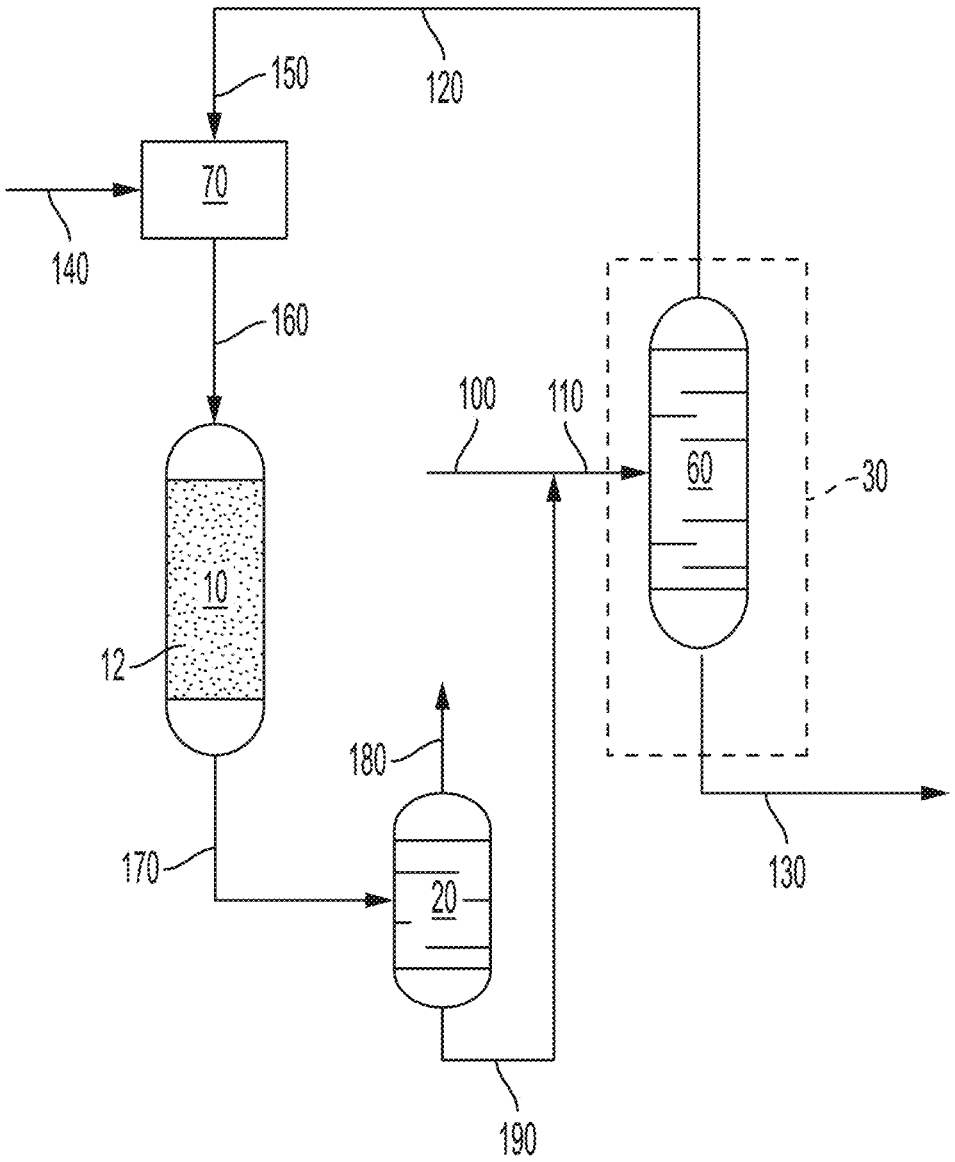
FIG. 3 is a schematic illustration of one or more embodiments of the process for reverse isomerization of a light naphtha feedstock of the present disclosure including adsorption based separation.
Figure 4:
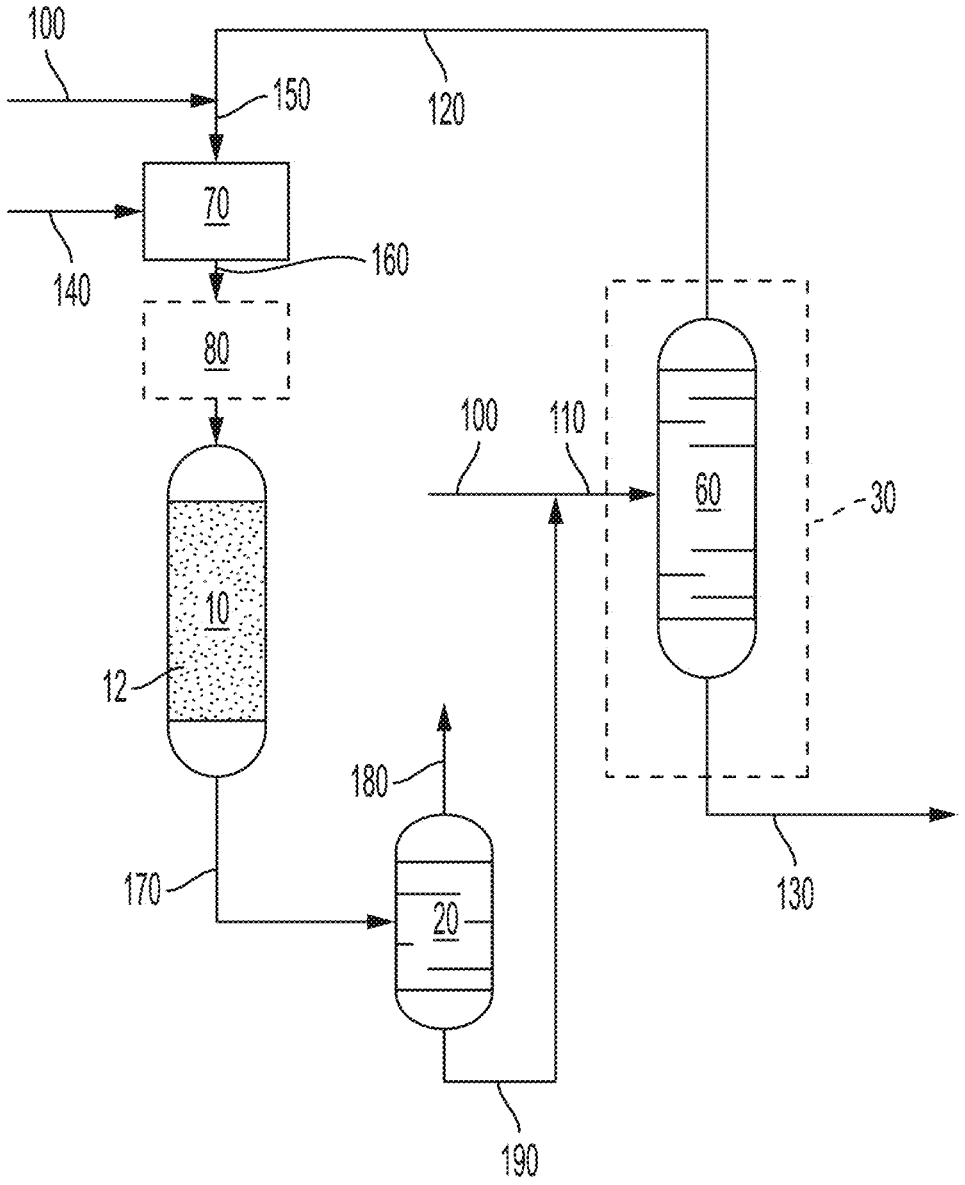
FIG. 4 is a schematic illustration of one or more embodiments of the process for reverse isomerization of a light naphtha feedstock of the present disclosure as illustrated in FIG. 3 including a second light naphtha feed.
Figure 5:
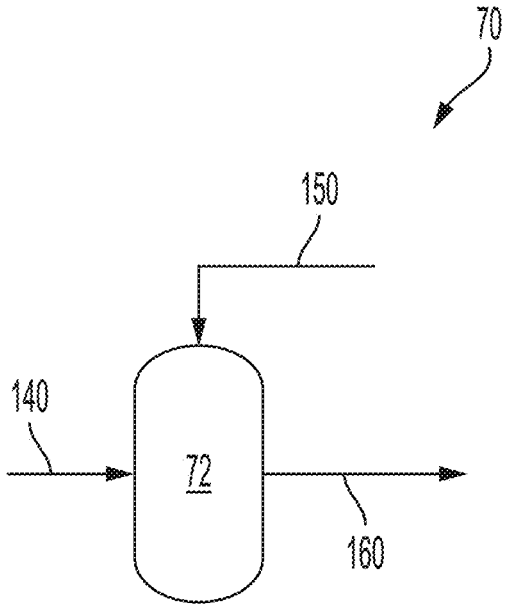
FIG. 5 is a schematic illustration of details of a mixing zone according to one or more embodiments of the present disclosure.

In one or more further embodiments and generally with reference to FIGS. 3 and 4, the separation unit 30 includes a molecular sieve separation column 60. The molecular sieve separation column 60 separates the mixed feed stream 110 into the iso-paraffin stream 120 and the one or more normal paraffin streams 130 with adsorption based separation.

Having disclosed the basic operation of the process for reverse isomerization of a light naphtha feedstock comprising branched $C_4$-$C_6$ paraffins, each step of the embodiments of the process is now provided in further detail.

Light Naphtha Feedstock

The light naphtha feedstock 100 comprises light naphtha. For purposes of this disclosure, light naphtha is considered to generally be paraffinic hydrocarbons containing 5 or 6 carbon atoms. Light naphtha generally has a boiling point range of 90 to 200° F. (approximately 32.2 to 93.3° C.). It is noted that the boiling points of iso-pentane is 28° C., n-pentane is 36° C., iso-hexanes is 50 to 62° C., and n-hexane is 69° C. respectively. However in a refinery, due to inefficient separation, there may carried over material in a light naphtha stream resulting in a limited amount of higher carbon number molecules as well. Specifically, depending on the source of light naphtha, cut-points, and reactor efficiency, a light naphtha stream may be composed of normal paraffins and iso-paraffins along with a minority percentage of normal and iso-olefins, saturated and unsaturated naphthenes, and even small portion of aromatic compounds such as benzene and toluene. However, for clarity the light naphtha feedstock 100 as discussed in the present disclosure is explicitly indicated as comprising branched $C_5$-$C_7$ paraffins where the $C_7$ concentration may range from 0.1-5 weight percent (wt. %). In further embodiments, the $C_7$ concentration in the light naphtha feedstock 100 may be 0.1 to 3 wt. %.

In various embodiments, the light naphtha feedstock 100 may comprise normal paraffins and iso-paraffins from various sources including crude oil, gas condensate, coal liquid, bio fuels, intermediate refinery processes, and their combinations. The intermediate refinery processes may include hydrocracking, hydrotreating, delayed coking, visbreaking, fluid catalytic cracking, and effluent of a residue hydroprocessing unit.

The light naphtha feedstock 100 to the process generally comprises normal and single branched $C_4$-$C_8$ paraffins, in certain embodiments normal and single branched $C_5$-$C_7$ paraffins, and in further embodiments normal and single branched $C_5$-$C_6$ paraffins. The $C_4$-$C_8$ paraffins, $C_5$-$C_7$ paraffins, or $C_5$-$C_6$ paraffins in various embodiments form a significant portion of the light naphtha feedstock 100. Typically, such feeds have a RON of less than 60. It will be appreciated by one skilled in the art that RON represents the research octane number which is a standardized measurement determined by running a fuel in a test engine with a variable compression ratio under controlled conditions, and comparing the results with those for mixtures of iso-octane and n-heptane.

In one or more embodiments, the light naphtha feedstock 100 consists of $C_4$ to $C_7$ hydrocarbons. That is the hydrocarbons provided in the light naphtha feedstock 100 have a carbon number between 4 and 7, inclusive.

In certain embodiments the light naphtha feedstock 100 is a light naphtha mixture having an initial boiling point in the range of about 10° C. to about 30° C. and a final boiling point in the range of about 70° C. to about 110° C. For example, in various embodiments, the light naphtha feedstock 100 has a boiling point range of 10° C. to 100° C., 20° C. to 80° C., or 30° C. to 70° C.

In one or more embodiments, the hydrocarbon feed stream 150 comprising the iso-paraffin stream 120 additionally comprises a second light naphtha feedstock 102. It will be appreciated that the addition of the second light naphtha feedstock 102 to the hydrocarbon feed stream 150 allows for greater control of the process. Specifically, the ratios of iso-paraffins and normal paraffins entering the reverse isomerization reactor 10 may be adjusted based on the inlet rate of the second light naphtha feedstock 102. Further, addition of the second light naphtha feedstock 102 allows for flow through the reverse isomerization reactor 10 as measured by the Liquid hourly space velocity (LHSV) to be stabilized regardless of variations in the split between iso-paraffins and normal paraffins and the removal of the one or more normal paraffin streams 130 in the separation unit 30.

In one or more embodiments, the light naphtha feedstock 100 and the second light naphtha feedstock 102 comprise substantially the same composition. However, it will be appreciated that in one or more embodiments, the light naphtha feedstock 100 and the second light naphtha feedstock 102 may comprise differing and distinct compositions. Regardless, the composition and physical parameters of the second light naphtha feedstock 102 should conform with those defined for the light naphtha feedstock 100. For example, the second light naphtha feedstock 102 may comprise normal paraffins and single branched $C_4$-$C_8$ paraffins, in certain embodiments normal and single branched $C_5$-$C_7$ paraffins, and in further embodiments normal and single branched $C_5$-$C_6$ paraffins. Further, the second light naphtha feedstock 102 may typically, have a RON of less than 60. Additionally, the second light naphtha feedstock 102 may include light naphtha mixture having an initial boiling point in the range of about 10° C. to about 30° C. and a final boiling point in the range of about 70° C. to about 110° C.

Separation Unit

The process for reverse isomerization of the light naphtha feedstock 100 includes feeding the mixed feed stream 110 to the separation unit 30 to generate the iso-paraffin stream 120 and the one or more normal paraffin streams 130. The mixed feed stream 110 comprises the light naphtha feedstock 100 and the stabilized isomerate stream 190. However, it will be appreciated that at initiation of the process for reverse isomerization of the light naphtha feedstock 100 the stabilized isomerate stream 190 has not yet been generated and as such the mixed feed stream 110 may initially consist of only the light naphtha feedstock 100. Alternatively, if the second light naphtha feedstock 102 is fed to the reverse isomerization reactor 10, the second light naphtha feedstock 102 may generate an initial supply of the stabilized isomerate stream 190.

In various embodiments, the separation unit 30 may comprise any separation device that at least partially separates one or more chemicals that are mixed in a process stream from one another. For example, the separation unit 30 may selectively separate differing chemical species from one another, forming one or more chemical fractions. Examples of separation units 30 include, without limitation, distillation columns, flash drums, knock-out drums, knock-out pots, centrifuges, filtration devices, traps, scrubbers, expansion devices, membranes, solvent extraction devices, and the like. It should be understood that separation processes described in this disclosure with regards to the separation unit 30 may not completely separate all of one chemical constituent from all of another chemical constituent. It should be understood that the separation processes described in this disclosure "at least partially" separate different chemical components from one another, and that even if not explicitly stated, it should be understood that separation may include only partial separation. However, even if not explicitly stated, it should be understood that separation may include complete separation in one or more embodiments as well.

It should be additionally understood that where only one separation unit 30 is depicted in a figure or described, two or more separation units 30 may be employed to carry out the identical or substantially identical separation. For example, where a separation unit 30 with multiple outlets is described or illustrated, it is contemplated that several separation units 30 arranged in series may equally separate the feed or feeds to the separation unit 30 and such embodiments are within the scope of the presently described embodiments.

In one or more embodiments and generally with reference to FIGS. 1 and 2, the separation unit 30 may operate on the basis of thermal separation of the various components of the mixed feed stream 110. In accordance with such embodiments, the separation unit 30 includes the deisopentanizer column 40 and the fractionator 50.

In accordance with such embodiments, the mixed feed stream 110 is provided to the deisopentanizer column 40 to separate iso-pentane as the iso-pentane stream 122 from the mixed feed stream 110 which generates a residual stream of the deisopentanizer effluent 200 comprising normal pentane and hexanes. The deisopentanizer effluent 200 is provided to the fractionator 50 to generate the iso-hexanes stream 124, the normal pentane stream 132, and the normal hexane stream 134. It is noted that the iso-pentane stream 122 and the iso-hexanes stream 124 may be combined to generate the iso-paraffin stream 120.

The deisopentanizer column 40 may include a simple flash column with no theoretical plates or a stripper with a gas or a steam or a single fractionation column with at least 15 theoretical trays or may include a plurality of atmospheric distillation units, vacuum distillation units, or both, which may be operated in series or in parallel to separate the mixed feed stream 110 comprising the light naphtha feedstock 100 and the isomerization effluent stream 190 into the iso-pentane stream 122 and the deisopentanizer effluent 200 comprising normal pentane and hexanes.

It is noted that iso-pentane forming the iso-pentane stream 122 has a boiling point of approximately 28° C. and normal pentane and hexanes forming the deisopentanizer effluent 200 have a boiling point of approximately 36° C. or greater. As such, the split between the iso-pentane stream 122 and the deisopentanizer effluent 200 is made in the range of 28° C. to 36° C. In various embodiments, the deisopentanizer column 40 may obtain cuts of the mixed feed stream 110 to the deisopentanizer column 40 within +/−5° C., +/−4° C., +/−3° C., or +/−2° C. Further, the pressure within the deisopentanizer column 40 is typically in the range of 1 to 3 bars.

The fractionator 50 may include a simple flash column with no theoretical plates or a stripper with a gas or a steam or a single fractionation column with at least 15 theoretical trays or may include a plurality of atmospheric distillation units, vacuum distillation units, or both, which may be operated in series or in parallel to separate the deisopentanizer effluent 200 into the iso-hexanes stream 124, the normal pentane stream 132, and the normal hexane stream 134.

It is noted that n-pentane forming the normal pentane stream 132 has a boiling point of approximately 36° C., iso-hexanes forming the iso-hexanes stream 124 have a boiling point of approximately 50 to 62° C., and normal hexane forming the normal hexane stream 134 has a boiling point of approximately 69° C. As such, the split between the iso-hexanes stream 124, the normal pentane stream 132 is made in the range of 36° C. to 50° C. and the split between the iso-hexanes stream 124 and the normal hexane stream 134 is made in the range of 62° C. to 69° C. In various embodiments, the fractionator 50 may obtain cuts of the deisopentanizer effluent 200 provide to the fractionator 50 within +/−5° C., +/−4° C., +/−3° C., or +/−2° C. Further, the pressure within the fractionator 50 is typically in the range of 1 to 3 bars.

In one or more embodiments and generally with reference to FIGS. 3 and 4, the separation unit 30 may operate on the basis of adsorption based separation of the various components of the mixed feed stream 110. In accordance with such embodiments, the separation unit 30 includes a molecular sieve separation column 60. The molecular sieve separation column 60 separates the mixed feed stream 110 into the iso-paraffin stream 120 and the one or more normal paraffin streams 130 directly with adsorption based separation. Operation of a separation column of similar nature to the molecular sieve separation column 60 is described in U.S. Pat. No. 4,176,053, incorporated herein by reference.

The one or more normal paraffin streams 130 generated by the separation unit 30 comprise primarily normal paraffins. In various embodiments, the one or more normal paraffin streams 130 comprises less than 20 percent by weight of iso-paraffins, less than 15 percent by weight of iso-paraffins, less than 10 percent by weight of iso-paraffins, less than 5 percent by weight of iso-paraffins, or less than 1 percent by weight of iso-paraffins.

The iso-paraffin stream 120 generated by the separation unit 30 comprise primarily iso-paraffins. In various embodiments, the iso-paraffin stream 120 comprises less than 20 percent by weight of normal paraffins, less than 15 percent by weight of normal paraffins, less than 10 percent by weight of normal paraffins, less than 5 percent by weight of normal paraffins, or less than 1 percent by weight of normal paraffins.

Reverse Isomerization Reactor

The process for reverse isomerization of the light naphtha feedstock 100 includes providing the hydrogen-enriched liquid feed stream 160 formed from mixing hydrogen gas 140 and the hydrocarbon feed stream 150 to the reverse isomerization reactor 10. The reverse isomerization reactor 10 can include one or more fixed-bed, moving-bed, fluidized-bed or batch reactor systems. For example, in one or more embodiments, the reverse isomerization reactor 10 comprises multiple individual reactors in series. In further embodiments, the reverse isomerization reactor 10 comprises an individual reactor. The hydrogen-enriched liquid feed stream 160 provided to the reverse isomerization reactor 10 can be contacted with the solid reverse isomerization catalyst particles 12 in an upward, downward, or radial-flow manner. The reverse isomerization reactor 10 can include a single reactor or multiple reactors with suitable fluid communication between reactors and thermal means and control to ensure that the desired reverse isomerization temperature is maintained at the inlet to each reactor.

In one or more embodiments, the reverse isomerization reactor 10 is operated by contacting the hydrogen-enriched liquid feed stream 160 with the solid reverse isomerization catalyst 12 for reverse hydroisomerization in a substantially two-phase liquid-solid reverse isomerization fixed-bed reaction zone under conditions that minimize cracking reactions and that are effective to convert iso-paraffins to normal paraffins and recover an equilibrium composition of normal and iso paraffins in the isomerization effluent stream 170.

In one or more embodiments, conditions within the reverse isomerization reactor 10 are effective to maintain least 90 V % of the hydrogen-enriched liquid feed stream 160 in liquid phase. In various further embodiments, conditions within the reverse isomerization reactor 10 are effective to maintain least 92 V % of the hydrogen-enriched liquid feed stream 160 in liquid phase, maintain least 95 V % of the hydrogen-enriched liquid feed stream 160 in liquid phase, or maintain least 98 V % of the hydrogen-enriched liquid feed stream 160 in liquid phase. It will be appreciated by one skilled in the art that maintaining the hydrogen-enriched liquid feed stream 160 in liquid phase allows the reverse isomerization reactor 10 to operate as a substantially two-phase system with the solid phase of the reverse isomerization catalyst 12 and the liquid phase of the hydrogen-enriched liquid feed stream 160. It is expressly noted that the hydrogen 140 which is traditionally provided to isomerization or reverse isomerization reactors in a gaseous phase is not present as a gaseous phase in accordance with embodiments of the present disclosure but is instead integrated into the liquid phase. Such arrangement alleviates the problem of gas hold-up that is typical of processed utilizing fixed-bed reactors of traditional design. One skilled in the art will appreciated that gas hold-up represents the reactor volume occupied by gaseous species.

In various embodiments, the reverse isomerization reactor 10 is operated at a temperature of from 20° C. to 300° C., 20° C. to 285° C., 20° C. to 180° C., 50° C. to 300° C., 50° C. to 285° C., 50° C. to 180° C., 80° C. to 300° C., 80° C. to 285° C., 80° C. to 180° C., 100° C. to 300° C., 100° C. to 285° C., or 100° C. to 180° C. Greater reaction temperatures are generally preferred to favor equilibrium mixtures having the highest concentration of normal alkanes. However, the reaction temperature should be constrained to avoid cracking of the hydrogen-enriched liquid feed stream 160 to lighter hydrocarbons at elevated temperatures.

In various embodiments, the reverse isomerization reactor 10 is operated at a pressure of 10 to 100 bars, 10 to 70 bars, 20 to 100 bars, 20 to 70 bars, 30 to 100 bars, or 30 to 70 bars. It will be appreciated that the pressure determines the amount of hydrogen dissolved in the liquid phase with lesser pressures representing less dissolved hydrogen and greater pressure representing more dissolved hydrogen.

In various embodiments, the reverse isomerization reactor 10 is operated at a Liquid hourly space velocity (LHSV) range from about 0.2 to 20 $h^{-1}$, 0.2 to 2 $h^{-1}$, 1 to 20 $h^{-1}$, or 1 to 2 $h^{-1}$.

In one or more specific embodiments, the reverse isomerization reactor 10 is operated at conditions effective to maintain at least 98 V % of the hydrogen-enriched liquid feed stream 160 in liquid phase and include a temperature of from 100° C. to 180° C., a pressure of from 20 bars to 70 bars, and a liquid hourly space velocity of 0.2 to 20 $h^{-1}$, with a hydrogen to hydrocarbon mole ratio of 0.01 to 20.0 in the hydrogen-enriched liquid feed stream 160.

Effective catalysts for use in the reverse isomerization reactor 10 include those known to persons having ordinary skill in the art. Reverse isomerization catalysts include, but are not limited to, those that are zeolitic or amorphous such as catalysts based upon amorphous alumina. Example solid reverse isomerization catalysts 12 may include platinum on alumina, zeolite, chlorinated alumina, a sulfated zirconia and platinum, a platinum group metal on chlorided alumina, or a sulfated zirconia. In one or more embodiments the solid reverse isomerization catalyst 12 comprises 0.05 wt. % to 5 wt. % of at least one Group VIIIB metal. In one or more further embodiments the solid reverse isomerization catalyst 12 comprises a base material including zeolite and metal oxides with metals from Group IIIA-B or IVA-B. It will be appreciated that the operating parameters of the reverse isomerization reactor 10 including temperature, pressure, and LHSV may depend upon the specific solid reverse isomerization catalyst 12 utilized within the reverse isomerization reactor 10. Conversely, the solid reverse isomerization catalyst 12 may be selected to be compatible with the standard operating parameters of the reverse isomerization reactor 10.

It will be appreciated that in one or more embodiments, operation of the reverse isomerization reactor 10 in accordance with the present disclosure may be effective to increase the RON for a typical feedstock of the light naphtha feedstock 100 to a RON of at least 80. Specifically, the typical feedstock of the light naphtha feedstock 100 has a RON of 60 or lower and treatment of the light naphtha feedstock 100 with the reverse isomerization reactor 10 increased the RON to at least 80, in certain embodiments at least 85, and in further embodiments at least 90.

In one or more embodiments, the light naphtha feedstock 100 is dried before providing to the separation unit 30. It will be appreciated that it is desirable to dry the light naphtha feedstock 100 as the potential exists for acid formation leading to catalyst poisoning and metal corrosion when residual moisture is retained. Additionally, in one or more embodiments, the iso-paraffin stream 120 is dried before providing to the reverse isomerization reactor 10. Similarly, in one or more embodiments, the second light naphtha feedstock 102 is dried before providing to the reverse isomerization reactor 10. Further, in one or more embodiments, the hydrogen gas 140 is dried before providing to the reverse isomerization reactor 10. It will be appreciated that the light naphtha feedstock 100, the second light naphtha feedstock 102, the iso-paraffin stream 120, and the hydrogen gas 140 may be dried separately or as the combined hydrogen-enriched liquid feed stream 160 before passage to the reverse isomerization reactor 10.

In various embodiments, the hydrogen-enriched liquid feed stream 160 comprises less than 0.1 parts per million by weight (ppmw) of water, less than 0.05 ppmw of water, less than 0.03 ppmw of water, less than 0.02 ppmw of water, less than 0.01 ppmw of water, less than 0.001 ppmw of water, or less than 0.001 ppmw of water. It will be appreciated that the hydrogen-enriched liquid feed stream 160 is typically substantially free of water in accordance with the present disclosure.

The sulfur and nitrogen content of the hydrogen-enriched liquid feed stream 160 may be reduced from the levels in the light naphtha feedstock 100 and the second light naphtha feedstock 102. Reduction of sulfur and nitrogen is desirable to prevent or alleviate deactivation of the solid reverse isomerization catalyst 12 or other catalysts in downstream refinery processes. In one or more embodiments, the hydrogen-enriched liquid feed stream 160 comprises less than 0.5 ppmw sulfur and less than 0.5 ppmw nitrogen when provided to the reverse isomerization reactor 10. In various embodiments, the hydrogen-enriched liquid feed stream 160 comprises less than 0.4 ppmw sulfur, less than 0.3 ppmw sulfur, less than 0.2 ppmw sulfur, or less than 0.1 ppmw sulfur. In various embodiments, the hydrogen-enriched liquid feed stream 160 comprises less than 0.4 ppmw nitrogen, less than 0.3 ppmw nitrogen, less than 0.2 ppmw nitrogen, or less than 0.1 ppmw nitrogen. It will be appreciated that the disclosed embodiments for the sulfur present in the hydrogen-enriched liquid feed stream 160 and the disclosed embodiments for the nitrogen present in the hydrogen-enriched liquid feed stream 160 are not necessarily exclusive and may be combined in any combination in various embodiments.

In one or more embodiments, the light naphtha feedstock 100 is processed to reduce the sulfur and nitrogen content before the light naphtha feedstock 100 is provided to the separator 30. Similarly, in one or more embodiments, the second light naphtha feedstock 102 is additionally or alternatively hydrotreated to reduce the sulfur and nitrogen content before the second light naphtha feedstock 102 is provided to the reverse isomerization reactor 10. It will be appreciated that remove of sulfur and nitrogen from both the light naphtha feedstock 100 and the second light naphtha feedstock 102 may be concurrently achieved by processing the hydrocarbon feed stream 150 before mixing the hydrogen gas 140 with the hydrocarbon feed stream 150 to form the hydrogen-enriched liquid feed stream 160. Sulfur removal is achieved in a hydrodesulfurization process performed in a "HDS unit" or "hydrotreater" (not shown). Generally, the hydrodesulfurization reaction takes place in a fixed-bed reactor at elevated temperatures of 200-425° C., sometimes more precisely 300-400° C., and elevated pressures of 1-20 MPa gauge, sometimes more precisely 1-13 MPa gauge, in the presence of a catalyst in a sulfide form comprising elements selected from the group consisting of Ni, Mo, Co, W and Pt, with or without promoters, supported on alumina. Similarly, nitrogen is removed through hydro-denitrogenation reactions in the fixed-bed reactor.

Stabilization Column

The process for reverse isomerization of the light naphtha feedstock 100 includes providing the isomerization effluent stream 170 to the stabilization column 20 to separate the isomerization effluent stream 170 into the $C_1$-$C_4$ hydrocarbon stream 180 and the stabilized isomerate stream 190. The stabilization column 20 removes or separates out the lighter components in the isomerization effluent stream 170 generated in the reverse isomerization reactor 10 as the $C_1$-$C_4$ hydrocarbon stream 180 to generate the stabilized isomerate stream 190. The stabilized isomerate stream 190 thus has a higher concentration of desirable $C_5$-$C_6$ hydrocarbons for collection as normal paraffins.

As the general operation of stabilization columns is known to one skilled in the art the reboilers, condensers, reflux lines, and other typical components of a stabilization column are not expressly illustrated in the Figures. However, it will be appreciated that, as appropriate, such components are contemplated as forming part of the stabilization column 20.

In one or more embodiments, the stabilization column 20 is operated at a pressure of 1 to 3 bar and a temperature of 120 to 140° C.

Hydrogen and Hydrocarbon Mixing Zone

The process for reverse isomerization of the light naphtha feedstock 100 includes mixing the hydrogen gas 140 and the hydrocarbon feed stream 150 comprising the iso-paraffin stream 120 to form the hydrogen-enriched liquid feed stream 160. With reference to all the Figures and specific reference to FIGS. 5 through 8, mixing the hydrogen gas 140 and the hydrocarbon feed stream 150 is completed in a mixing zone 70. The mixing zone 70 has at least one inlet for receiving the hydrocarbon feed stream 150 and at least one inlet for receiving the hydrogen gas 140 and an outlet for discharging the hydrogen-enriched liquid feed stream 160. It will be appreciated that the at least one inlet for receiving the hydrocarbon feed stream 150 and at least one inlet for receiving the hydrogen gas 140 may be combined into a single combined inlet for receiving both the hydrocarbon feed stream 150 the hydrogen gas 140.

In one or more embodiments, the mixing zone 70 may simply be the piping carrying the hydrocarbon feed stream 150 such that the hydrogen gas 140 is added directly to the hydrocarbon feed stream 150 and integrated through turbulence in the flow before entering the isomerization reactor 10. Hydrogen can be added at the solubility limit to prevent any gas phase hydrogen rendering a simpler solution for a low hydrogen consumption system.

During operation the system and execution of the process for reverse isomerization of the light naphtha feedstock 100, the hydrocarbon feed stream 150 is intimately mixed with the hydrogen gas 140 in the mixing zone 70 to dissolve a predetermined quantity of the hydrogen gas 140 in the light naphtha feedstock 100 and produce the hydrogen-enriched liquid feed stream 160. The hydrogen gas 140 includes fresh hydrogen introduced via stream 142 and optionally recycled hydrogen introduced via stream 144 from an optional flashing zone 76 which removes excess hydrogen. In addition, in certain embodiments hydrogen can be recycled after separation from the isomerization effluent stream 170 in the stabilization column 20.

Figure 6:
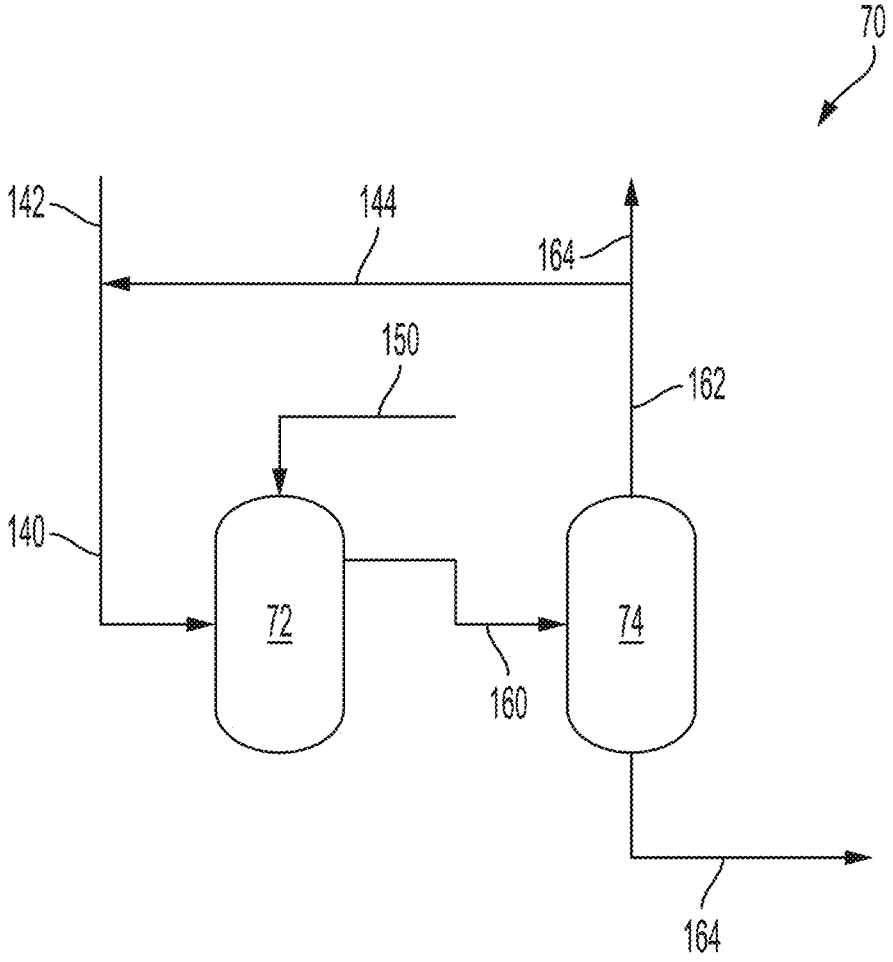
FIG. 6 is a schematic illustration of details of the mixing zone of FIG. 5 including a flashing zone.
Figure 8:
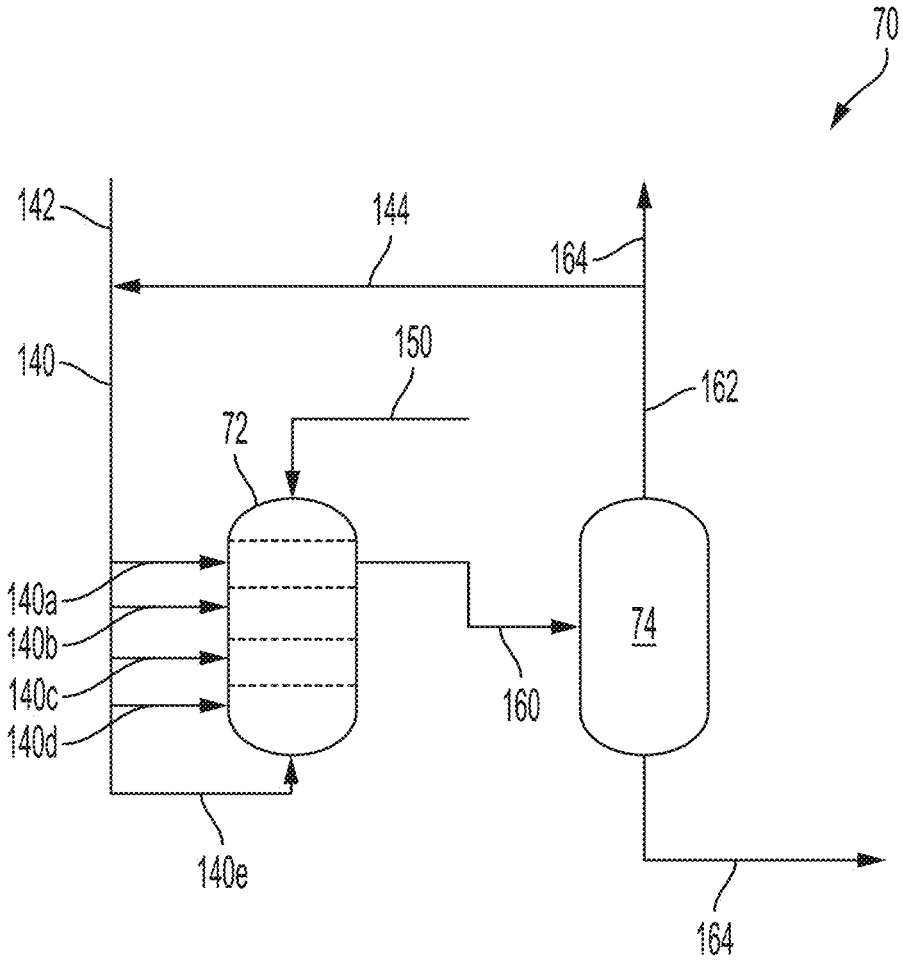
FIG. 8 is a schematic illustration of details of the mixing zone of FIG. 8 including a flashing zone.

In one or more embodiments in which excess hydrogen gas 140 is combined with the hydrocarbon feed stream 150 in the mixing zone 62 and with reference to FIGS. 6 and 8, the hydrogen-enriched liquid feed stream 160 is conveyed to a flashing zone 74 in which undissolved hydrogen and other gases such as light feedstock fractions may be flashed off and removed as stream 162. The heavier fraction 164, which is the hydrogen-enriched liquid feed stream 160 with excess hydrogen removed, serves as the feed to the reverse isomerization reactor 10.

A portion 144 of stream 162 can optionally be recycled and mixed with the fresh hydrogen feed 142. The amount of recycled hydrogen in the hydrogen gas 140 generally depends upon a variety of factors relating to the excess undissolved hydrogen recovered from the flashing zone 74. For instance, the amount of stream 144 relative to stream 162 can be in the range of about 50 to 100 V %, 50 to 99.5 V %, 50 to 99 V %, 50 to 95 V %, 80 to 100 V %, 80 to 99.5 V %, 80 to 99 V %, 80 to 95 V %, 90 to 100 V %, 90 to 99.5 V %, 90 to 99 V %, or 90 to 95 V %. A remaining portion of the flashed gases can be discharged from the system as a bleed stream 164, in embodiments where portion 144 is not 100 V % of stream 162. Bleed stream 164, the portion of stream 162 not recycled as stream 144, is effective to remove accumulated impurities.

The mixing zone 70 can be any apparatus that achieves the necessary intimate mixing of liquid and gas so that a sufficient amount of the hydrogen gas 140 is dissolved in the hydrocarbon feed stream 150. The mixing zone 70 can include a combined inlet for the hydrogen gas 140 and the hydrocarbon feed stream 150 or separate inlets as depicted in FIGS. 5 through 8. Mixing zone 70 can be a separate vessel or unit operation, in-line mixing apparatus, or a combination thereof to achieve the requisite hydrogen saturation.

Effective unit operations for a hydrogen distributor vessel 72 in the mixing zone 70 include one or more gas-liquid distributor vessels, which apparatus can include spargers, injection nozzles, or other devices that impart sufficient velocity to inject the hydrogen gas 140 into the hydrocarbon feed stream 150 with turbulent mixing and thereby promote hydrogen saturation. Suitable apparatus are described with respect to FIGS. 5 through 8 herein, and also, for instance, in U.S. Pat. Nos. 3,378,349; 3,598,541; 3,880,961; 4,960,571; 5,158,714; 5,484,578; 5,837,208; 5,942,197; and 11,155,757, the relevant portions of which are incorporated herein by reference.

Figure 7:
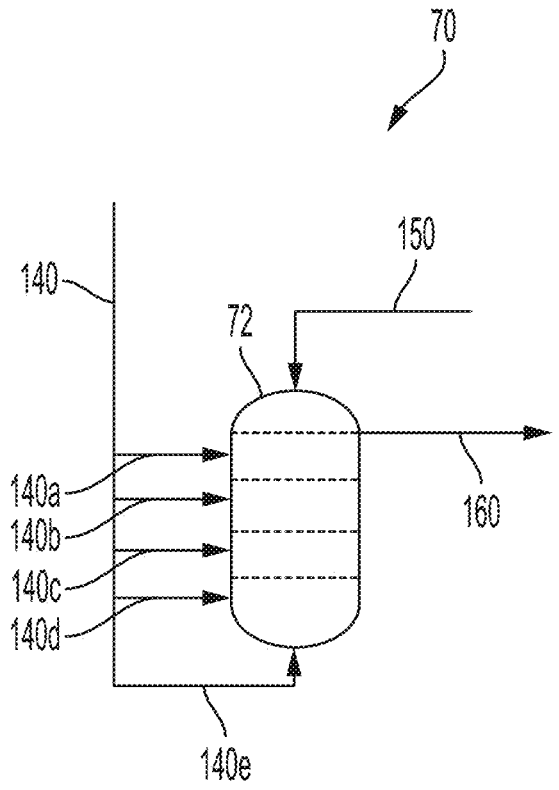
FIG. 7 is a schematic illustration of details of a mixing zone according to one or more embodiments of the present disclosure.

In certain embodiments, such as, for example, shown in FIGS. 7 and 8, a column is used as the hydrogen distributor vessel 72, in which the hydrogen gas 140 is injected at plural locations 140*a*, 140*b*, 140*c*, 140*d* and 140*e*. The hydrogen gas 140 is injected through hydrogen distributors into the column for adequate mixing to effectively dissolve the hydrogen gas 140 in the hydrocarbon feed stream 150. For instance, suitable injection nozzles can be provided proximate several plates (locations 112*a*-112*d*) and also at the bottom of the column (location 112*e*). The hydrocarbon feed stream 150 can be fed from the top of the column as shown in the figures or from the bottom of the column (not shown).

Various types of hydrogen distributor apparatus can be used. For instance, the gas distributor apparatuses can include one or both of tubular injectors fitted with nozzles and jets that are configured to uniformly distribute hydrogen gas into the flowing hydrocarbon feed stream 150 in a column or vessel in order to achieve a saturation state in the hydrogen distributor vessel 72.

Operating conditions in the mixing zone 70 and more particularly the hydrogen distributor vessel 72 are selected to promote solubility of the hydrogen gas 140 within the hydrocarbon feed stream 150. The mixing zone 70 is maintained at pressure levels of from about 5 bars to about 200 bars, and at a ratio of the normalized volume of hydrogen to the volume of liquid hydrocarbon of about 30 to about 300 normalized liters of hydrogen per liter of liquid hydrocarbon.

The optional flashing zone 74 can include one or more flash drums that are maintained at suitable operating conditions to maintain an effective amount of the hydrogen gas 140 in solution in the hydrogen-enriched liquid feed stream 160.

In various embodiments, the generated hydrogen-enriched liquid feed stream 160 is sent to the reverse isomerization reactor 10 at a hydrogen to hydrocarbon mole ratio of from about 0.01 to 20, 0.01 to 10, 0.01 to 1, 0.02 to 20, 0.02 to 10, 0.02 to 1, 0.05 to 20, 0.05 to 10, or 0.05 to 1. In one or more embodiments, the hydrogen-enriched liquid feed stream 160 is saturated with hydrogen.

Saturation Reactor

In one or more embodiments, the hydrogen-enriched liquid feed stream 160 is provided to a saturation reactor 80 upstream of the reverse isomerization reactor 10 to convert benzene in the hydrogen-enriched liquid feed stream 160 to cyclohexene prior to introduction to the reverse isomerization reactor 10. In one or more embodiments, the hydrocarbon feed stream 150 is provided to the saturation reactor 80 upstream of the mixing zone 70 to convert benzene in the hydrocarbon feed stream 150 to cyclohexene prior to introduction to the reverse isomerization reactor 10. One skilled in the art will appreciate that benzene in the presence of hydrogen over a platinum-containing catalyst will generate heat and saturate to cyclohexene. Such benzene saturation reaction is fast and happens near the inlet of the reverse isomerization reactor 10 if no saturation reactor 80 is provided to pretreat the hydrogen-enriched liquid feed stream 160 before the reverse isomerization reactor 10. As such, the saturation reactor 80 may be placed upstream of the reverse isomerization reactor 10 to convert benzene in the hydrogen-enriched liquid feed stream 160 to cyclohexene prior introduction to the reverse isomerization reactor 10. Further, in one or more embodiments, the saturation reactor 80 may be located upstream of the mixing zone 70 such that benzene in hydrocarbon feed stream 150 is converted to cyclohexene prior to passage to the mixing zone 70 and introduction of the hydrogen gas 140.

It will be appreciated that it is desirable convert benzene to cyclohexene prior to introduction to the isomerization reactor 10 as cyclic compounds may be adsorbed on the catalyst in the isomerization reactor 10 which reduces the active sites available for paraffin isomerization. As such, if the feed to the isomerization reactor 10 contains significant amounts of cyclic compounds, such as benzene, the catalyst inventory in the isomerization reactor 10 has to be increased. Unsaturated cyclic hydrocarbons consume considerable quantities of hydrogen, resulting in exothermic reactions disrupting preferred isomerization equilibrium. Without wishing to be bound by theory, it is believed that each 1 vol. % of benzene leads to 10° C. exotherm. As such, with high benzene content, the isomerization reaction temperature may be undesirably increased.

In one or more embodiments, the one or more normal paraffin streams 130 are provided to a steam cracking unit for ethylene production. In further embodiments, the one or more normal paraffin streams 130, the $C_1$-$C_4$ hydrocarbon stream 180, or both are provided to further unit operations for further processing inti useful or value added compositions.

EXAMPLES

The following examples illustrate features of the present disclosure but are not intended to limit the scope of the disclosure.

To verify and demonstrate the normal paraffin recovery with processes and systems in accordance with the present disclosure, a material balance model was prepared for a processing scheme in accordance with the present disclosure. Specifically, a light straight run naphtha stream in accordance with the light naphtha feedstock 100 was processed. Specifically, light straight run naphtha composed of pentanes and hexanes with iso to normal weight ratio of 42.9:52.7 with contaminants of less than 0.5 ppmw of sulfur and less than 0.1 ppmw of nitrogen and oxygenates was used as a feed. It is noted that water present in the feed was separated from the feed during subsequent fractionation of the feed and the feed was dried before being provided to the isomerization reactor. The composition of the light straight run naphtha stream was in accordance with the composition of Table 1.

TABLE 1

Light Naphtha Feedstock Composition (kg/hr)

| Component | Light Naphtha Feedstock |
|---|---|
| Hydrogen | 0.0 |
| Water | 0.1 |
| i-butanes | 0.0 |
| n-butanes | 1.1 |
| i-pentanes | 19.0 |
| n-pentanes | 32.8 |
| 2.2. dimethybutanes | 0.2 |
| 2.3. dimethybutanes | 3.4 |
| 2.methypentane | 12.5 |
| 3.methypentane | 7.8 |
| n-hexane | 18.8 |
| methycyclopentane | 2.2 |
| cyclohexane | 0.6 |
| benzene | 1.4 |
| n-heptane | 0.2 |
| TOTAL | 100.0 |

The light straight run naphtha stream representing the light naphtha feedstock 100 and a stream representing the stabilized isomerate stream 190 were combined to form a stream representing the mixed feed stream 110. The composition of the stabilized isomerate stream 190 and the mixed feed stream 110 are detailed in Table 2.

TABLE 2

Stabilized Isomerate Stream and Mixed Feed Stream Compositions (kg/hr)

| Component | Stabilized Isomerate Stream | Mixed Feed Stream |
|---|---|---|
| Hydrogen | 0.0 | 0.0 |
| Water | 0.0 | 0.1 |
| i-butanes | 0.3 | 0.3 |
| n-butanes | 0.6 | 1.6 |
| i-pentanes | 25.4 | 44.4 |
| n-pentanes | 8.0 | 40.8 |
| 2.2. dimethybutanes | 8.6 | 8.8 |
| 2.3. dimethybutanes | 2.8 | 6.2 |
| 2.methypentane | 8.8 | 21.3 |
| 3.methypentane | 4.6 | 12.4 |
| n-hexane | 2.8 | 21.7 |
| methycyclopentane | 0.8 | 2.9 |
| cyclohexane | 0.8 | 1.4 |

TABLE 2-continued

| Stabilized Isomerate Stream and Mixed Feed Stream Compositions (kg/hr) | | |
|---|---|---|
| Component | Stabilized Isomerate Stream | Mixed Feed Stream |
| benzene | 0.0 | 1.4 |
| n-heptane | 0.4 | 0.5 |
| TOTAL | 63.8 | 163.8 |

The mixed feed stream 110 was provide to a deisopentantanizer 40 in accordance with the present disclosure to generate the iso-pentane stream 122 and the deisopentanizer effluent 200. The composition of the iso-pentane stream 122 and the deisopentanizer effluent 200 are detailed in Table 3.

TABLE 3

| Iso-Pentane Stream and Deisopentanizer Effluent Compositions (kg/hr) | | |
|---|---|---|
| Component | Iso-Pentane Stream | Deisopentanizer Effluent |
| Hydrogen | 0.0 | 0.0 |
| Water | 0.1 | 0.0 |
| i-butanes | 0.3 | 0.0 |
| n-butanes | 1.6 | 0.0 |
| i-pentanes | 42.2 | 2.2 |
| n-pentanes | 2.0 | 38.7 |
| 2.2. dimethybutanes | 0.4 | 8.4 |
| 2.3. dimethybutanes | 0.3 | 5.9 |
| 2.methypentane | 1.1 | 20.2 |
| 3.methypentane | 0.6 | 11.8 |
| n-hexane | 1.1 | 20.6 |
| methycyclopentane | 0.1 | 2.8 |
| cyclohexane | 0.1 | 1.3 |
| benzene | 0.1 | 1.3 |
| n-heptane | 0.0 | 0.5 |
| TOTAL | 50.1 | 113.7 |

The deisopentanizer effluent 200 was provide to a fractionator 50 in accordance with the present disclosure and operating at 100° C. and 3 bars to generate the iso-hexanes stream 124, the normal pentane stream 132, and the normal hexane stream 134. The composition of the iso-hexanes stream 124, the normal pentane stream 132, and the normal hexane stream 134 are detailed in Table 4.

TABLE 4

| Iso-Hexanes Stream and Normal Paraffin Streams Compositions (kg/hr) | | | |
|---|---|---|---|
| Component | Iso-Hexanes Stream | Normal Pentane Stream | Normal Hexane Stream |
| Hydrogen | 0.0 | 0.0 | 0.0 |
| Water | 0.0 | 0.0 | 0.0 |
| i-butanes | 0.0 | 0.0 | 0.0 |
| n-butanes | 0.0 | 0.0 | 0.0 |
| i-pentanes | 2.2 | 0.0 | 0.0 |
| n-pentanes | 1.9 | 36.8 | 0.0 |
| 2.2. dimethybutanes | 7.9 | 0.4 | 0.0 |
| 2.3. dimethybutanes | 5.6 | 0.3 | 0.0 |
| 2.methypentane | 19.2 | 1.0 | 0.0 |
| 3.methypentane | 11.2 | 0.6 | 0.0 |
| n-hexane | 0.0 | 1.0 | 19.6 |
| methycyclopentane | 0.0 | 0.1 | 2.7 |
| cyclohexane | 0.0 | 0.1 | 1.2 |
| benzene | 0.0 | 0.1 | 1.2 |

TABLE 4-continued

| Iso-Hexanes Stream and Normal Paraffin Streams Compositions (kg/hr) | | | |
|---|---|---|---|
| Component | Iso-Hexanes Stream | Normal Pentane Stream | Normal Hexane Stream |
| n-heptane | 0.0 | 0.0 | 0.5 |
| TOTAL | 48.1 | 40.4 | 25.2 |

The iso-pentane stream 122 and the iso-hexanes stream 124 were combined with hydrogen gas at a hydrogen to hydrocarbon mole ratio of 0.05 to generate the hydrogen-enriched liquid feed stream 160 fed to the isomerization reactor 10. The composition of the hydrogen-enriched liquid feed stream 160 is detailed in Table 5.

TABLE 5

| Hydrogen and Hydrogen-Enriched Liquid Feed Stream Compositions (kg/hr) | | |
|---|---|---|
| Component | Hydrogen Stream | Hydrogen-Enriched Liquid Feed Stream |
| Hydrogen | 1.5 | 1.5 |
| Water | 0.0 | 0.1 |
| i-butanes | 0.0 | 0.3 |
| n-butanes | 0.0 | 1.6 |
| i-pentanes | 0.0 | 44.4 |
| n-pentanes | 0.0 | 4.0 |
| 2.2. dimethybutanes | 0.0 | 8.4 |
| 2.3. dimethybutanes | 0.0 | 5.9 |
| 2.methypentane | 0.0 | 20.3 |
| 3.methypentane | 0.0 | 11.8 |
| n-hexane | 0.0 | 1.1 |
| methycyclopentane | 0.0 | 0.1 |
| cyclohexane | 0.0 | 0.1 |
| benzene | 0.0 | 0.1 |
| n-heptane | 0.0 | 0.0 |
| TOTAL | 1.5 | 99.7 |

The hydrogen-enriched liquid feed stream 160 was fed to the isomerization reactor 10 and processed according to the present disclosure. Specifically, the isomerization reactor 10 was operated with a platinum on chlorinated alumina catalyst at a temperature of 100° C., pressure of 50 bars, and LHSV of 1.6 $h^{-1}$. After further processing in a stabilization column 20, the stabilized isomerate stream 190 as detailed in Table 2 was generated.

It will be appreciated that 65.6 kg/h of normal hexanes were generated (combination of the normal pentane stream 132 and the normal hexane stream 134 as detailed in Table 4) from the input of 100 kg/h of the light naphtha feedstock. As the light naphtha feedstock had an iso to normal weight ratio of 50:50 this represents a significant shift toward normal paraffins.

It should now be understood the various aspects of the process and associate system for reverse isomerization of a light naphtha feedstock comprising branched $C_5$-$C_7$ paraffins are described and such aspects may be utilized in conjunction with various other aspects.

According to a first aspect, a process for reverse isomerization of a light naphtha feedstock comprising branched $C_5$-$C_7$ paraffins includes feeding a mixed feed stream comprising the light naphtha feedstock to a separation unit to generate an iso-paraffin stream and one or more normal paraffin streams; mixing hydrogen gas and a hydrocarbon feed stream comprising the iso-paraffin stream to form a hydrogen-enriched liquid feed stream; providing the hydrogen-enriched liquid feed stream to a reverse isomerization reactor; operating the reverse isomerization reactor by contacting the hydrogen-enriched liquid feed stream with a solid reverse isomerization catalyst for reverse hydroisomerization in a substantially two-phase liquid-solid reverse isomerization fixed-bed reaction zone under conditions that minimize cracking reactions and that are effective to convert iso-paraffins to normal paraffins and recovering an equilibrium composition of normal and iso paraffins in an isomerization effluent stream; providing the isomerization effluent stream to a stabilization column to separate the isomerization effluent stream into a $C_1$-$C_4$ hydrocarbon stream and a stabilized isomerate stream; and combining the stabilized isomerate stream with the light naphtha feedstock to generate the mixed feed stream.

A second aspect includes the process of the first aspect in which the hydrocarbon feed stream additionally comprises a second light naphtha feedstock.

A third aspect includes the process of the second aspect the light naphtha feedstock and the second light naphtha feedstock comprise substantially the same composition.

A fourth aspect includes the process of any of the first through third aspects in which the light naphtha feedstock consists of $C_4$ to $C_7$ hydrocarbons.

A fifth aspect includes the process of any of the first through fourth aspects in which the light naphtha feedstock has a boiling range of 10 to 100° C.

A sixth aspect includes the process of any of the first through fourth aspects in which the light naphtha feedstock has a boiling range of 20 to 80° C.

A seventh aspect includes the process of any of the first through sixth aspects in which the light naphtha feedstock has a RON of 60 or less.

An eighth aspect includes the process of any of the first through seventh aspects in which the isomerate effluent stream has a RON of at least 80.

A ninth aspect includes the process of any of the first through eighth aspects in which the light naphtha feedstock is dried before providing to the separation unit.

A tenth aspect includes the process of any of the first through ninth aspects in which the iso-paraffin stream is dried before providing to the reverse isomerization reactor.

An eleventh aspect includes the process of any of the first through tenth aspects in which the second light naphtha feedstock is dried before providing to the reverse isomerization reactor.

A twelfth aspect includes the process of any of the first through eleventh aspects in which the hydrogen gas is dried before providing to the reverse isomerization reactor.

A thirteenth aspect includes the process of any of the first through twelfth aspects in which the hydrogen-enriched liquid feed stream comprises less than 0.05 ppmw of water.

A fourteenth aspect includes the process of any of the first through thirteenth aspects in which the hydrogen-enriched liquid feed stream comprises less than 0.5 ppmw sulfur and less than 0.5 ppmw nitrogen.

A fifteenth aspect includes the process of the fourteenth aspect in which the light naphtha feedstock is hydrotreated to reduce the sulfur and nitrogen content.

A sixteenth aspect includes the process of the fourteenth or fifteenth aspect s in which the second light naphtha feedstock, if present, is hydrotreated to reduce the sulfur and nitrogen content.

A seventeenth aspect includes the process of any of the first through sixteenth aspects in which the reverse isomerization reactor is operated at a temperature of from 20° C. to 300° C.

An eighteenth aspect includes the process of any of the first through seventeenth aspects in which the reverse isomerization reactor is operated at a temperature of from 100° C. to 180° C.

A nineteenth aspect includes the process of any of the first through eighteenth aspects in which the reverse isomerization reactor is operated at a pressure of from 10 bars to 100 bars.

A twentieth aspect includes the process of any of the first through nineteenth aspects in which the reverse isomerization reactor is operated at a pressure of from 20 bars to 70 bars.

A twenty-first aspect includes the process of any of the first through twentieth aspects in which the reverse isomerization reactor is operated at a LHSV of 0.2 to 20 $h^{-1}$.

A twenty-second aspect includes the process of any of the first through twenty-first aspects in which the reverse isomerization reactor is operated at a LHSV of 1 to 2 $h^{-1}$.

A twenty-third aspect includes the process of any of the first through twenty-second aspects in which the hydrogen-enriched liquid feed stream comprises a hydrogen to hydrocarbon mole ratio of 0.01 to 20.0.

A twenty-fourth aspect includes the process of any of the first through twenty-third aspects in which the hydrogen-enriched liquid feed stream comprises a hydrogen to hydrocarbon mole ratio of 0.02 to 10.0.

A twenty-fifth aspect includes the process of any of the first through twenty-fourth aspects in which the hydrogen-enriched liquid feed stream is saturated with hydrogen.

A twenty-sixth aspect includes the process of any of the first through twenty-fifth aspects in which the conditions within the reverse isomerization reactor are effective to maintain least 90 V % of the hydrogen-enriched liquid feed stream in liquid phase.

A twenty-seventh aspect includes the process of any of the first through twenty-sixth aspects in which the conditions within the reverse isomerization reactor are effective to maintain least 95 V % of the hydrogen-enriched liquid feed stream in liquid phase.

A twenty-eighth aspect includes the process of any of the first through twenty-seventh aspects in which the conditions within the reverse isomerization reactor are effective to maintain least 98 V % of the hydrogen-enriched liquid feed stream in liquid phase.

A twenty-ninth aspect includes the process of any of the first through twenty-eighth aspects in which the solid reverse isomerization catalyst comprises 0.05 wt. % to 5 wt. % of at least one Group VIIIB metal.

A thirtieth aspect includes the process of any of the first through twenty-ninth aspects in which the solid reverse isomerization catalyst comprises a base material including zeolite and metal oxides with metals from Group IIIA-B or IVA-B.

A thirty-first aspect includes the process of any of the first through thirtieth aspects in which the solid reverse isomerization catalyst is chlorinated.

A thirty-second aspect includes the process of any of the first through thirty-first aspects in which the reverse isomerization reactor comprises multiple individual reactors in series.

A thirty-third aspect includes the process of any of the first through thirty-second aspects in which mixing the hydrocarbon feed stream and the hydrogen gas to form the hydrogen-enriched liquid feed stream is achieved in a mixing zone that comprises one or more gas-liquid distributor vessels that include a plurality of hydrogen distribution apparatus, each hydrogen distribution apparatus comprising a tubular injector fitted with a nozzle, a jet, or a nozzle and jet and that is configured to uniformly distribute hydrogen gas into the hydrocarbon feed stream to achieve a saturation state in the mixing zone.

A thirty-fourth aspect includes the process of the thirty-third aspect in which the one or more gas-liquid distributor vessels is a column having a top, a bottom and plural plates, and wherein a hydrogen distribution apparatus is included at the bottom and at each of the plates.

A thirty-fifth aspect includes the process of any of the first through thirty-fourth aspects in which the reverse isomerization reactor is operated at conditions effective to maintain at least 98 V % of the hydrogen-enriched liquid feed stream in liquid phase and include a temperature of from 100° C. to 180° C., a pressure of from 20 bars to 70 bars, and a liquid hourly space velocity of 0.2 to 20 $h^{-1}$, with a hydrogen to hydrocarbon mole ratio of 0.01 to 20.0 in the hydrogen-enriched liquid feed stream.

A thirty-sixth aspect includes the process of any of the first through thirty-fifth aspects in which the hydrogen-enriched liquid feed stream is provided to a saturation reactor upstream of the reverse isomerization reactor to convert benzene in the hydrogen-enriched liquid feed stream to cyclohexene prior introduction to the reverse isomerization reactor.

A thirty-seventh aspect includes the process of any of the first through thirty-sixth aspects in which the one or more normal paraffin streams comprises less than 20 percent by weight of iso-paraffins.

A thirty-eighth aspect includes the process of any of the first through thirty-seventh aspects in which the one or more normal paraffin streams comprises less than 5 percent by weight of iso-paraffins.

A thirty-ninth aspect includes the process of any of the first through thirty-eighth aspects in which the one or more normal paraffin streams comprises less than 1 percent by weight of iso-paraffins.

A fortieth aspect includes the process of any of the first through thirty-ninth aspects in which the separation unit comprises a deisopentanizer column and a fractionator, wherein: the mixed feed stream is provided to the deisopentanizer column to separate iso-pentane as an iso-pentane stream from the mixed feed stream to generate a deisopentanizer effluent comprising normal pentane and hexanes, the deisopentanizer effluent is provided to the fractionator to generate an iso-hexanes stream, a normal pentane stream, and a normal hexane stream; and combining the iso-pentane stream and the iso-hexanes stream to generate the iso-paraffin stream.

A forty-first aspect includes the process of any of the first through thirty-ninth aspects in which the separation unit comprises a molecular sieve separation column, wherein the molecular sieve separation column separates the mixed feed stream into the iso-paraffin stream and the one or more normal paraffin streams with adsorption based separation.

A forty-second aspect includes the process of any of the first through forty-first aspects in which the one or more normal paraffin streams are provided to a steam cracking unit for ethylene production.

A forty-third includes the process of any of the first through forty-second aspects in which the light naphtha feedstock is limited to 0.1 to 5 wt. % of $C_7$ hydrocarbons.

A forty-four includes the process of any of the first through forty-third aspects in which the light naphtha feedstock is limited to 0.1 to 3 wt. % of $C_7$ hydrocarbons.

It should be apparent to those skilled in the art that various modifications and variations can be made to the described embodiments without departing from the spirit and scope of the claimed subject matter. Thus, it is intended that the specification cover the modifications and variations of the various described embodiments provided such modifications and variations come within the scope of the appended claims and their equivalents.

The verb "comprises" and its conjugated forms should be interpreted as referring to elements, components or steps in a non-exclusive manner. The referenced elements, components or steps may be present, utilized or combined with other elements, components or steps not expressly referenced. For the purposes of defining the present technology, the transitional phrase "consisting of" may be introduced in the claims as a closed preamble term limiting the scope of the claims to the recited components or steps and any naturally occurring impurities. For the purposes of defining the present technology, the transitional phrase "consisting essentially of" may be introduced in the claims to limit the scope of one or more claims to the recited elements, components, materials, or method steps as well as any non-recited elements, components, materials, or method steps that do not materially affect the novel characteristics of the claimed subject matter. The transitional phrases "consisting of" and "consisting essentially of" may be interpreted to be subsets of the open-ended transitional phrases, such as "comprising" and "including," such that any use of an open ended phrase to introduce a recitation of a series of elements, components, materials, or steps should be interpreted to also disclose recitation of the series of elements, components, materials, or steps using the closed terms "consisting of" and "consisting essentially of." For example, the recitation of a composition "comprising" components A, B, and C should be interpreted as also disclosing a composition "consisting of" components A, B, and C as well as a composition "consisting essentially of" components A, B, and C. Any quantitative value expressed in the present application may be considered to include open-ended embodiments consistent with the transitional phrases "comprising" or "including" as well as closed or partially closed embodiments consistent with the transitional phrases "consisting of" and "consisting essentially of."

It is noted that one or more of the following claims utilize the term "where" as a transitional phrase. For the purposes of defining the present technology, it is noted that this term is introduced in the claims as an open-ended transitional phrase that is used to introduce a recitation of a series of characteristics of the structure and should be interpreted in like manner as the more commonly used open-ended preamble term "comprising."

It should be understood that any two quantitative values assigned to a property may constitute a range of that property, and all combinations of ranges formed from all stated quantitative values of a given property are contemplated in this disclosure. That is, it is envisioned that each discrete value encompassed by the ranges are also included. Additionally, the ranges which may be formed by each discrete value encompassed by the explicitly disclosed ranges are equally envisioned. For brevity, the same is not explicitly indicated subsequent to each disclosed range and the present general indication is provided.

Throughout the disclosure there is indication of specific parameters being "less than" a value without a specified lower bound. It will be appreciated that such indication implicitly includes the range from zero to the specified value.

Having described the subject matter of the present disclosure in detail and by reference to specific embodiments, it is noted that the various details described in this disclosure should not be taken to imply that these details relate to elements that are essential components of the various embodiments described in this disclosure, even in cases where a particular element is illustrated in each of the drawings that accompany the present description. Rather, the claims appended hereto should be taken as the sole representation of the breadth of the present disclosure and the corresponding scope of the various embodiments described in this disclosure. Further, it will be apparent that modifications and variations are possible without departing from the scope of the appended claims.

What is claimed is:

1. A process for reverse isomerization of a light naphtha feedstock comprising branched $C_5$-$C_7$ paraffins, the process comprising:

feeding a mixed feed stream comprising the light naphtha feedstock to a separation unit to generate an iso-paraffin stream and one or more normal paraffin streams;

mixing hydrogen gas and a hydrocarbon feed stream comprising the iso-paraffin stream in a mixing zone to fully dissolve the hydrogen gas in the hydrocarbon feed stream to form a hydrogen-enriched liquid feed stream;

providing the hydrogen-enriched liquid feed stream to one or more reverse isomerization reactors, wherein the hydrogen-enriched liquid feed stream is provided to a saturation reactor upstream of the reverse isomerization reactor to convert benzene in the hydrogen-enriched liquid feed stream to cyclohexene prior introduction to the reverse isomerization reactor;

operating the reverse isomerization reactor by contacting the hydrogen-enriched liquid feed stream with a solid reverse isomerization catalyst for reverse hydroisomerization in a two-phase liquid-solid reverse isomerization fixed-bed reaction zone under conditions that minimize cracking reactions and that are effective to convert iso-paraffins to normal paraffins and recovering an equilibrium composition of normal and iso paraffins in an isomerization effluent stream;

providing the isomerization effluent stream to a stabilization column to separate the isomerization effluent stream into a $C_1$-$C_4$ hydrocarbon stream and a stabilized isomerate stream; and combining the stabilized isomerate stream with the light naphtha feedstock to generate the mixed feed stream.

2. The process of claim 1, wherein the hydrocarbon feed stream additionally comprises a second light naphtha feedstock.

3. The process of claim 2, wherein the light naphtha feedstock and the second light naphtha feedstock comprise the same composition.

4. The process of claim 1, wherein the light naphtha feedstock has a RON of 60 or less.

5. The process of claim 4, wherein the isomerate effluent stream has a RON of at least 80.

6. The process of claim 1, wherein the reverse isomerization reactor is operated at a temperature of from 20° C. to 300° C.

7. The process of claim 1, wherein the reverse isomerization reactor is operated at a pressure of from 10 bars to 100 bars.

8. The process of claim 1, wherein the reverse isomerization reactor is operated at a LHSV of 0.2 to 20 $h^{-1}$.

9. The process of claim 1, wherein the hydrogen-enriched liquid feed stream comprises a hydrogen to hydrocarbon mole ratio of 0.01 to 20.0.

10. The process of claim 1, wherein the conditions within the reverse isomerization reactor are effective to maintain least 90 V % of the hydrogen-enriched liquid feed stream in liquid phase.

11. The process of claim 1, wherein the solid reverse isomerization catalyst comprises 0.05 wt. % to 5 wt. % of at least one Group VIIIB metal.

12. The process of claim 1, wherein the solid reverse isomerization catalyst comprises a base material including zeolite and metal oxides with metals from Group IIIA-B or IVA-B.

13. The process of claim 1, wherein the one or more reverse isomerization reactors comprises multiple individual reactors in series.

14. The process of claim 1, wherein the reverse isomerization reactor is operated at conditions effective to maintain at least 98 V % of the hydrogen-enriched liquid feed stream in liquid phase and include a temperature of from 100° C. to 180° C., a pressure of from 20 bars to 70 bars, and a liquid hourly space velocity of 0.2 to 20 $h^{-1}$, with a hydrogen to hydrocarbon mole ratio of 0.01 to 20.0 in the hydrogen-enriched liquid feed stream.

15. The process of claim 1, wherein the one or more normal paraffin streams comprises less than 20 percent by weight of iso-paraffins.

16. The process of claim 1, wherein the separation unit comprises a deisopentanizer column and a fractionator, wherein:

the mixed feed stream is provided to the deisopentanizer column to separate iso-pentane as an iso-pentane stream from the mixed feed stream to generate a deisopentanizer effluent comprising normal pentane and hexanes, the deisopentanizer effluent is provided to the fractionator to generate an iso-hexanes stream, a normal pentane stream, and a normal hexane stream; and combining the iso-pentane stream and the iso-hexanes stream to generate the iso-paraffin stream.

17. The process of claim 1, wherein the separation unit comprises a molecular sieve separation column, wherein the molecular sieve separation column separates the mixed feed stream into the iso-paraffin stream and the one or more normal paraffin streams with adsorption based separation.

* * * * *